US006223699B1

(12) United States Patent
Donauer et al.

(10) Patent No.: US 6,223,699 B1
(45) Date of Patent: May 1, 2001

(54) INJECTOR FOR AN INTERNAL COMBUSTION ENGINE WORKING WITH FUEL/EMULSION

(75) Inventors: Georg Donauer, Friedrichshafen; Bernd Danckert, Meckenbeuren, both of (DE)

(73) Assignee: MTU Motoren-Und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/403,141

(22) PCT Filed: Apr. 11, 1998

(86) PCT No.: PCT/EP98/02192

§ 371 Date: Dec. 28, 1999

§ 102(e) Date: Dec. 28, 1999

(87) PCT Pub. No.: WO98/46875

PCT Pub. Date: Oct. 22, 1998

(30) Foreign Application Priority Data

Apr. 16, 1997 (DE) ..... 197 15 785

(51) Int. Cl.[7] ..... F02M 43/04

(52) U.S. Cl. ..... 123/25 C; 123/299; 123/575

(58) Field of Search ..... 123/25 C, 575, 123/299, 576, 577, 578, 25 R, 304

(56) References Cited

U.S. PATENT DOCUMENTS 4,831,970 * 5/1989 Caputo ..... 123/575
5,170,751 * 12/1992 Tosa et al. ..... 123/25 C
5,174,247 * 12/1992 Tosa et al. ..... 123/25 C
5,529,024 * 6/1996 Wirbeleit et al. ..... 123/25 C
5,651,346 * 7/1997 Remmels et al. ..... 123/25 C
5,671,717 * 9/1997 Rembold et al. ..... 123/25 C
5,722,377 * 3/1998 Schoenfeld et al. ..... 123/25 C

FOREIGN PATENT DOCUMENTS 44 35 823 C1 12/1995 (DE) .
43 37 048 C2 1/1996 (DE) .
44 45 980 A1 7/1996 (DE) .
195 35 703 A1 4/1997 (DE) .
0 553 364 A1 8/1993 (EP) .
6-193529 7/1994 (JP) .

* cited by examiner

*Primary Examiner*—Andrew M. Dolinar
*Assistant Examiner*—Arnold Castro
(74) *Attorney, Agent, or Firm*—Evenson, McKeown, Edwards & Lenahan, P.L.L.C.

(57) ABSTRACT

The present application relates to an injector for use in an internal combustion engine designed to work with fuel/emulsion. Two fuel inlet passages, which are connected to a multichannel distributor and used for feeding fuel from a high pressure hose, are linked with a mixing unit surrounding the nozzle needle. Downstream of the multichannel distributor, in the vicinity of the mixing unit, a make-up liquid inlet passage is connected to a second fuel inlet passage through which the make-up liquid, especially water, is fed to produce emulsified fuel. An amount of make-up liquid V, fed during a pause between two injections from the first make-up liquid supply passage to the second fuel inlet passage, is entirely injected during the following injection phase by the high pressure fuel, supplied as a make-up fuel by a shift valve device, into the combustion chamber of the internal combustion engine, so that the second fuel inlet passage and the fuel capacity of the injector are both entirely flushed by the make-up fuel, thereby preventing, during the working breaks of the internal combustion engine, any corrosion by water rests from the emulsion which might remain in the injector.

19 Claims, 1 Drawing Sheet

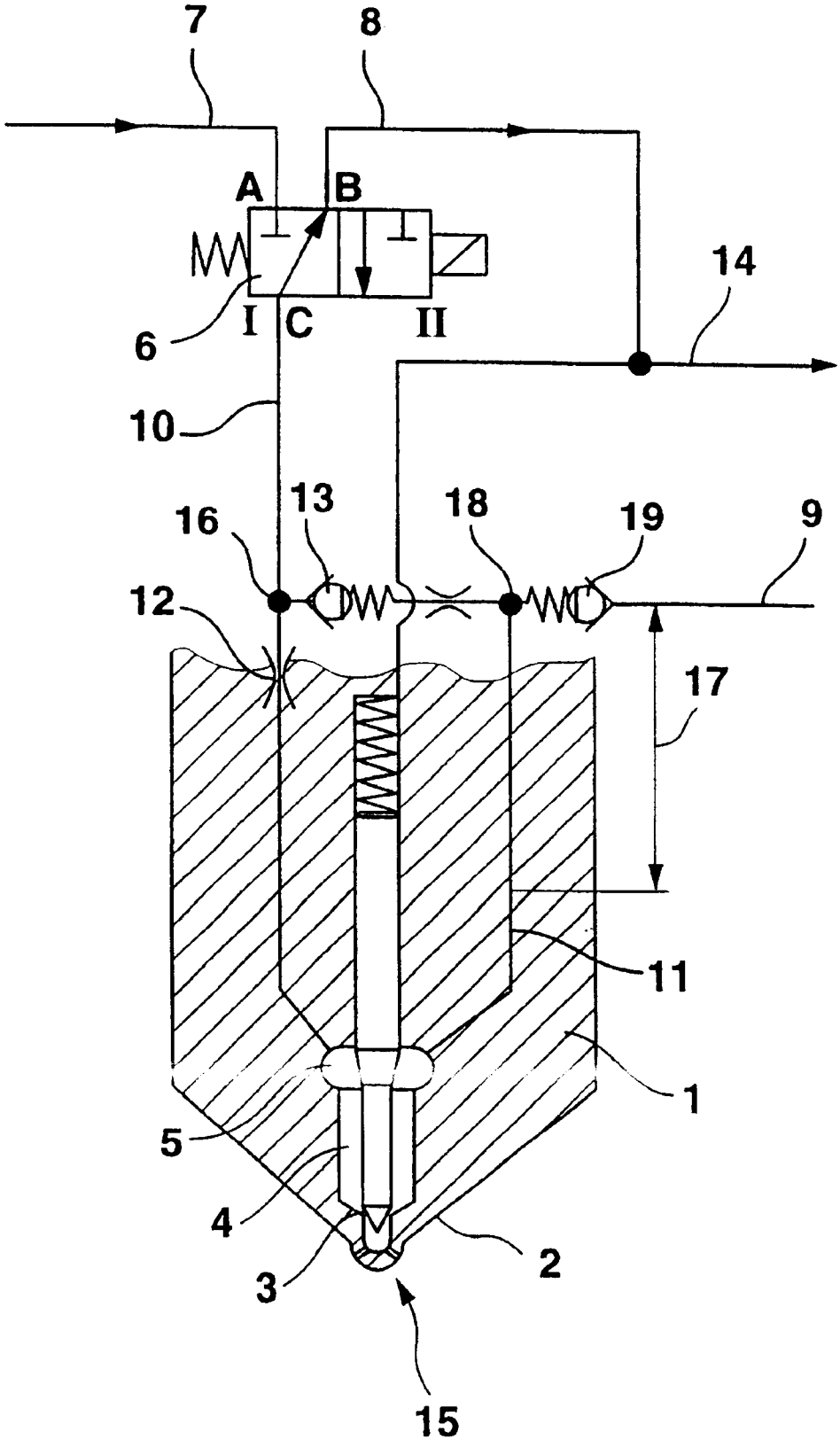
7
8
A
B
14
6
I
C
II
10
16
13
18
19
9
12
17
11
1
5
4
2
3
15

INJECTOR FOR AN INTERNAL COMBUSTION ENGINE WORKING WITH FUEL/EMULSION

The invention relates to a fuel injector for an internal combustion engine for fuel/emulsion operation.

Fuel/emulsion operation is being used increasingly in internal combustion engines, especially large-volume diesel engines, in which pure fuel or an emulsion composed of fuel and an added fluid that can be emulsified with air is burned depending on the operating and load state of the engine. When diesel fuel is used, water in particular is used as the added fluid. The emulsion is preferably produced in the fuel injector of the engine by intensive mixing of fuel and added fluid. One disadvantage of emulsion operation is that during operating pauses, water from the emulsion remains in the feed line and inside the fuel injector, causing undesired corrosion there.

A fuel injector for an internal combustion engine for fuel/emulsion operation is known from DE 44 35 823 C1 of Applicant, in which the fuel and the added fluid used to form the emulsion are supplied through respective supply channels in parallel to a mixing chamber provided in the fuel injector and are intimately mixed with one another using the kinetic flow energy of the fluid flows supplied. No measures are provided in this case that prevent the water contained in the emulsion from remaining during operating pauses and thus possibly producing corrosion.

An internal combustion engine is known from EP 0 5 53 364 A1 for fuel/emulsion operation in which the fuel injector has supply channels for parallel feed of pure fuel and a flow of fuel and water supplied in layers to a mixing chamber provided in the fuel injector. Here again, no measures are provided in the fuel injector to prevent water from remaining and thus causing corrosion in the fuel injector.

SUMMARY OF THE INVENTION

The goal of the invention is to provide a fuel injector for an internal combustion engine for fuel/emulsion operation in which corrosion by the water used to form the emulsion is prevented.

This goal is achieved by the fuel injector of the present invention.

The invention provides a fuel injector for an internal combustion engine for fuel/emulsion operation which has an injection nozzle formed by an nozzle needle and a nozzle needle cone for injecting fuel into the combustion chamber of the internal combustion engine in response to actuation of the nozzle needle. The fuel injector also has a fuel volume formed by a nozzle chamber surrounding the nozzle needle and a mixing chamber connected with the nozzle chamber, as well as a first fuel supply channel terminating in the mixing chamber to supply fuel under high pressure delivered from a high-pressure line, into the fuel volume and a second fuel supply channel likewise terminating in the mixing chamber for parallel supply of an added fluid flow, especially water, under high pressure that forms an emulsion with the fuel, into the fuel volume, as well as an added fluid supply channel that serves to supply the added fluid to the second fuel supply channel during pauses in injection. A switching valve device serves to control the amount of fluid supplied to the first and second fuel supply channels. According to the invention, provision is made such that the second fuel supply channel can be connected optionally by the switching valve device for supplying fuel with the high-pressure line supplying the fuel, and that the added fluid supply channel that serves to supply the added fluid to the second fuel supply channel terminates downstream of the switching valve device in the second fuel supply channel in such fashion that a volume V of added fluid that is delivered during an injection pause from the added fluid supply channel to the second fuel supply channel, during a subsequent injection phase of the fuel under high pressure delivered through the switching valve device, is completely injected into the combustion chamber of the internal combustion engine.

The advantage of the fuel injector according to the invention is that the second fuel supply channel as well as the fuel volume of the injector are completely flushed by fuel supplied through the second fuel supply channel so that during operating pauses, no emulsion-containing water remains in the fuel injector that could cause corrosion.

According to one embodiment of the invention, provision is made such that the first fuel supply channel or the second fuel supply channel can be connected by the switching valve device with a fuel return line through which compressed fluid flows from the second fuel supply channel during the supply of added fluid from the added fluid supply channel.

According to one characteristic of the invention, provision is made such that a throttle device is provided in the second fuel supply channel downstream of the switching valve device that limits the through flow of fuel. Such a throttle device has the advantage that the quantity of fuel that flows through the second fuel supply channel can be controlled in simple fashion.

A throttle device of this kind advantageously can be formed by a check valve that opens in the direction of the injection flow.

According to another characteristic of the invention, provision is made such that a throttle device that limits the through flow of fuel is also provided in the first fuel supply channel downstream of the switching valve device.

It is especially advantageous if, in both the first and the second fuel supply channels, throttle devices are provided that are so dimensioned that the quantity of fuel flowing through the second fuel supply channel is sufficient to deliver the quantity V of added fluid present in the second fuel channel completely into the mixing chamber, and that the quantity of fuel flowing through both fuel channels is sufficient to force the amount of fuel present in the fuel volume of the injector completely out of the injector. For this purpose, both throttle devices can be designed to be adjustable.

Advantageously, provision is made such that the mixing chamber is designed as an annular chamber surrounding the nozzle needle, that the two fuel supply channels terminate on opposite sides in the mixing chamber, and that the added fluid supply channel terminates close to the mixing chamber in the second fuel supply channel. This ensures that during the injection pause, accumulated water, regardless of the quantity of water, is conveyed each time at the beginning of the injection phase into the mixing chamber and forms an emulsion together with the fuel introduced through the first fuel supply channel.

Advantageously, the two fuel supply channels in the fuel injector run essentially parallel to the lengthwise axis of the injector on opposite sides of the nozzle needle.

According to one preferred embodiment of the invention, the first fuel supply channel can be connected by the switching valve device with a fuel return line. At the same time, the second fuel supply channel branches off from the first fuel supply channel downstream of the switching device and upstream of the throttle device provided in the first fuel supply channel, so that the flow of fuel supplied by the switching device from the high-pressure injection line to the first fuel supply channel is divided between the first and second fuel supply channels. The added fluid supply channel terminates downstream of the throttle device provided in the second fuel supply channel. The throttle device, in this embodiment is designed either as an adjustable throttle device or as a check valve that opens in the injection direction, with a corresponding throttle effect.

According to another advantageous embodiment of the invention, provision is made such that the switching valve device is designed as a 3/2-way valve which, during injection pauses, blocks the first fuel supply channel and connects the second fuel supply channel with the return line, and which during the injection phase connects both fuel supply channels with the high-pressure line that supplies the fuel.

BRIEF DESCRIPTION OF THE DRAWINGS

One embodiment of the invention is explained below with reference to the drawing.

The FIGURE shows a schematic cross section of a fuel injector for an internal combustion engine for fuel/emulsion operation according to one embodiment of the invention.

DESCRIPTION OF THE PREFERRED EMBODIMENTS

The FIGURE shows a fuel injector 1 which serves to supply fuel/emulsion to the combustion chamber of an internal combustion engine. The fuel or emulsion is in particular diesel fuel and an emulsion composed of diesel fuel and water. Fuel injector 1 contains a nozzle needle 2 which, together with a nozzle needle cone 3 that serves as a valve seat for nozzle needle 2, forms an injection nozzle 15. Nozzle needle 2 can be moved back and forth by means of a control mechanism that is known of itself and is not itself shown in the FIGURE, for opening and closing injection nozzle 15 along the lengthwise axis of fuel injector 1. Nozzle needle 2 is surrounded in the lower part of fuel injector 1 by a fuel volume which is likewise formed by a nozzle chamber 4 that is annular and surrounds nozzle needle 2 and an annular mixing chamber 5 that likewise surrounds nozzle needle 2. On both sides of nozzle needle 2, a first fuel supply channel 10 and a second fuel supply channel 11 run parallel to mixing chamber 5. Both fuel supply channels 10, 11 are connected by a switching valve device 6 in the form of a 3/2-way valve. The first fuel supply channel 10 is coupled to a connection C of multichannel distributor 6 and optionally by a connection A thereof with a high-pressure line 7 which supplies fuel under high pressure, for example from a common rail, or can be coupled to a connection B thereof. Connection B is connected with a return line 8 which carries away excess fuel from fuel injector 1. The second fuel supply channel 11 branches off downstream of multichannel distributor 6 from the first fuel feed 10. Downstream of branching location 16, a throttle device 12 is provided in the first fuel supply channel 10 and a check valve 13 is provided in the second fuel supply channel 11. Immediately downstream of check valve 13 is an added fluid supply channel 9, connected with the second fuel supply channel 11. The added fluid supply channel 9 serves to supply the added fluid, especially water, which is used to form the fuel/water emulsion in mixing chamber 5. The termination of the added fluid supply channel 9 in the second fuel supply channel 11 is located so far downstream of multichannel distributor 6 that the maximum quantity V of added fluid required to produce the emulsion for an injection process is received completely in the second fuel supply channel 11, as shown in the drawing by the double arrow 17. An overflow oil line 14 serves to carry away leakage and control amounts from the injector.

During the injection pause between two successive injection processes, multichannel distributor 6 is switched to the position I shown in the FIGURE. In this position I the flow of fuel from high-pressure line 7 to the first fuel supply channel 10 is interrupted. The first fuel supply channel 10 is connected with return line 8 by linking connections C and B of multichannel distributor 6. Through the added fluid supply channel 9, a quantity of the added fluid precisely dimensioned to match the operating or load state of the engine is delivered by means of a feed device not shown in the FIGURE to the second fuel supply line 11, with this quantity, forcing out the fuel that is present in the second fuel supply channel 11 through the mixing chamber 5 and the first fuel supply channel 10 into the return line 8, in the area shown in the FIGURE by arrow 17, being stored downstream of the termination point 18 of the added fluid supply channel 9. To inject fuel into the combustion chamber of the engine, at the beginning of the injection phase the multichannel distributor 6 is switched from switch position I into switch position II, with the connection between connections B and C of multichannel distributor 6 being broken, and at the same time connections A and C are linked with one another and thus the inward flow of fuel from high-pressure line 7 into the first fuel supply channel 10 is permitted. By means of branching location 16, the second fuel supply channel 11 is also connected with high-pressure line 7, so that fuel under high pressure flows from high-pressure line 7 into the second fuel supply channel 11 as well. The fuel located in the two fuel supply channels 10, 11 is forced by the fuel delivered from high-pressure line 7 under high pressure into mixing chamber 5, whereupon the volume V of added fluid contained in the second fuel supply channel 11 is entrained and forced into mixing chamber 5 with the fuel to form an emulsion and after passing through the nozzle chamber 4 is injected through injection nozzle 15 into the combustion chamber of the engine.

As a result of the dimensioning of the two fuel supply channels 10, 11 and suitable dimensioning of the throttle device 12 as a function of the throttle resistance of check valve 13 and by a suitable choice of the volume of mixing chamber 5 and nozzle chamber 4, the flow conditions in fuel injector 1 are adjusted so that the quantity V of added fluid is displaced completely into mixing chamber 5 by the fuel delivered through the multichannel distributor into the second fuel supply channel 11. The quantity of fuel continuing to flow through the two fuel supply channels 10, 11 is dimensioned so that it is sufficient to inject completely the emulsion formed into the combustion chamber of the engine so that the fuel supply channels as well as the fuel volume 4, 5 of the fuel injector are completely flushed by the incoming fuel, so that no water from the emulsion remains in the fuel injector that could cause corrosion. This means that throttle devices 12, 13 are dimensioned and adjusted to one another in such fashion that the quantity of fuel flowing through the second fuel supply channel 11 is sufficient at the beginning of the injection phase to displace completely into the mixing chamber 5 the added fluid volume stored in the second fuel supply channel 11, from which point the emulsion formed there is injected by the fuel delivered through both fuel supply channels 10, 11 out of fuel volume 4, 5 of injector 1 completely into the combustion chamber of the engine.

The throttle device 13 located in the second fuel supply channel 11 can be formed by a check valve that opens in the direction of the injection flow.

Following the end of the injection process, the multichannel distributor 6 is switched back again into the position shown in the FIGURE. Following the injection process, the entire interior of fuel injector 1 is flushed completely by fuel so that in the event of an operating pause of the internal combustion engine, no corrosion can develop as a result of the water from the emulsion remaining inside fuel injector 1.

What is claimed is:

1. Fuel injector for an internal combustion engine for fuel/emulsion operation, comprising:

an injection nozzle formed by a nozzle needle, a nozzle needle cone for injecting fuel or a fuel emulsion into a combustion chamber of the internal combustion engine in response to an actuation of the nozzle needle, said nozzle needle defining a fuel volume formed by a nozzle chamber surrounding said nozzle needle cone and a mixing chamber connected with said nozzle chamber, a first fuel supply channel terminating in said mixing chamber for supplying fuel under high pressure, supplied by a high-pressure line, into said fuel volume, a second fuel supply channel likewise terminating in said mixing chamber for parallel supply, under high pressure, of an added fluid, forming an emulsion with the fuel, into said fuel volume, an added fluid supply channel that serves during injection pauses to supply added fluid to the second fuel supply channel, and a multichannel distributor for controlling at least the quantity of fluid fed to said first fuel supply channel, wherein said second fuel supply channel can be connected by said multichannel distributor for filling with fuel with said high-pressure line supplying the fuel, and wherein said added fluid supply channel serving to supply added fluid to said second fuel supply channel terminates downstream of said multichannel distributor in said second fuel supply channel in such fashion that a quantity of the added fluid delivered during an injection pause from said added fluid supply channel into said second fuel supply channel, during a subsequent injection phase of the fuel provided through said multichannel distributor under high pressure, is injected completely into the combustion chamber of the internal combustion engine.

2. Fuel injector according to claim 1, wherein at least one of the first fuel supply channel and the second fuel supply channel can be connected by said multichannel distributor with a fuel return line, through which, during the supply of added fluid from the added fluid supply channel, fuel forced out of said second fuel supply channel flows out.

3. Fuel injector according to claim 2, wherein said mixing chamber is designed as an annular chamber surrounding said nozzle needle, wherein the first and second fuel supply channels terminate on opposite sides in said mixing chamber, and wherein said added fluid supply channel terminates close to said mixing chamber in said second fuel supply channel.

4. Fuel injector according to claim 2, wherein said mixing chamber is designed as an annular chamber surrounding said nozzle needle, the first and second fuel supply channels terminate on opposite sides in said mixing chamber, and wherein said added fluid supply channel terminates close to said mixing chamber in said second fuel supply channel.

5. Fuel injector according to claim 2, wherein in said second fuel supply channel, downstream of said multichannel distributor, a throttle device that limits the through flow of fuel is provided.

6. Fuel injector according to claim 5, wherein said throttle device is formed by a check valve that opens in the direction of the injection flow.

7. Fuel injector according to claim 1, wherein in said second fuel supply channel, downstream of said multichannel distributor, a throttle device that limits the through flow of fuel is provided.

8. Fuel injector according to claim 7, wherein said mixing chamber is designed as an annular chamber surrounding said nozzle needle, wherein the first and second fuel supply channels terminate on opposite sides in said mixing chamber, and wherein said added fluid supply channel terminates close to said mixing chamber in said second fuel supply channel.

9. Fuel injector according to claim 7, wherein said throttle device is formed by a check valve that opens in the direction of the injection flow.

10. Fuel injector according to claim 9, wherein the first fuel supply channel, downstream of said multichannel distributor, is provided with a throttle device that limits the through flow of fuel.

11. Fuel injector according to claim 10, wherein said first fuel supply channel is connected by said multichannel distributor with a fuel return line, wherein said second fuel supply channel, downstream of said multichannel distributor and upstream of said throttle device provided in said first fuel supply channel, is connected in a conducting fashion with said first fuel supply channel, with said added fluid supply channel terminating downstream of said throttle device formed by a check valve in the second fuel supply channel.

12. Fuel injector according to claim 10, wherein said mixing chamber is designed as an annular chamber surrounding said nozzle needle, wherein the first and second fuel supply channels terminate on opposite sides in said mixing chamber, and wherein said added fluid supply channel terminates close to said mixing chamber in said second fuel supply channel.

13. Fuel injector according to claim 11, wherein said throttle devices are dimensioned so that the fuel volume flowing through said second fuel supply channel is sufficient to deliver completely into the mixing chamber at least the quantity of the added fluid present in said second fuel supply channel, and wherein the volume of fuel flowing through both the first and second fuel supply channels is sufficient to force the quantity of fuel emulsion present in said nozzle and mixing chambers of the injector completely out of the injector.

14. Fuel injector according to claim 11, wherein said multichannel distributor is a 3/2-way valve, which during injection pauses, connects said first fuel supply channel with said fuel return line and which, during the injection phase, connects both said first and second fuel supply channels with said high-pressure line supplying fuel.

15. Fuel injector according to claim 13, wherein said mixing chamber is designed as an annular chamber surrounding said nozzle needle, wherein the first and second fuel supply channels terminate on opposite sides in said mixing chamber, and wherein said added fluid supply channel terminates close to said mixing chamber in said second fuel supply channel.

16. Fuel injector according to claim 13, wherein said multichannel distributor is a 3/2-way valve, which during injection pauses, connects said first fuel supply channel with said fuel return line and which, during the injection phase, connects both said first and second fuel supply channels with said high-pressure line supplying fuel.

17. Fuel injector according to claim 1, wherein said mixing chamber is designed as an annular chamber surrounding said nozzle needle, wherein the first and second fuel supply channels terminate on opposite sides in said mixing chamber, and wherein said added fluid supply channel terminates close to said mixing chamber in said second fuel supply channel.

18. Fuel injector according to claim 17, characterized in that the first and second fuel supply channels run essentially parallel to the lengthwise axis of the fuel injector on opposite sides of said nozzle needle.

19. Fuel injector according to claim 1, wherein said added fluid is water.

* * * * *